US009651054B2

(12) United States Patent
Chang et al.

(10) Patent No.: US 9,651,054 B2
(45) Date of Patent: May 16, 2017

(54) SERIES FAN FRAME BODY STRUCTURE MADE OF DIFFERENT MATERIALS

(71) Applicant: Asia Vital Components Co., Ltd., New Taipei (TW)

(72) Inventors: Bor-Haw Chang, New Taipei (TW); Shu-Fan Liu, New Taipei (TW); Shu-Fen Liu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 646 days.

(21) Appl. No.: 14/177,829

(22) Filed: Feb. 11, 2014

(65) Prior Publication Data

US 2015/0226230 A1 Aug. 13, 2015

(51) Int. Cl.

| | |
|---|---|
| ***F04D 19/00*** | (2006.01) |
| ***F04D 29/02*** | (2006.01) |
| ***F04D 29/40*** | (2006.01) |
| ***F04D 25/06*** | (2006.01) |
| ***F04D 29/60*** | (2006.01) |
| ***F04D 29/66*** | (2006.01) |

(52) U.S. Cl.

CPC ..... *F04D 29/023* (2013.01); *F04D 19/007* (2013.01); *F04D 25/0613* (2013.01); *F04D 29/601* (2013.01); *F04D 29/668* (2013.01); *F05D 2260/96* (2013.01); *F05D 2300/43* (2013.01)

(58) Field of Classification Search

CPC .... F04D 29/023; F04D 19/007; F04D 29/601; F04D 29/668; F04D 25/0613; F05D 2260/96; F05D 2300/43

See application file for complete search history.

(56) References Cited

U.S. PATENT DOCUMENTS

| | | | | |
|---|---|---|---|---|
| 6,244,818 | B1 * | 6/2001 | Chang | F01D 25/24 415/193 |
| 6,948,912 | B2 * | 9/2005 | Chang | F04D 29/384 416/185 |
| 7,156,611 | B2 * | 1/2007 | Oosawa | F04D 19/007 415/199.5 |
| 7,175,399 | B2 * | 2/2007 | Matsumoto | H05K 7/2019 417/423.14 |
| 7,238,004 | B2 * | 7/2007 | Lin | F01D 1/02 415/182.1 |

(Continued)

FOREIGN PATENT DOCUMENTS

| | | |
|---|---|---|
| CN | 2908871 Y | 6/2007 |
| CN | 201593527 U | 9/2010 |

(Continued)

*Primary Examiner* — Igor Kershteyn

(74) *Attorney, Agent, or Firm* — C. G. Mersereau; Nikolai & Mersereau, P.A.

(57) ABSTRACT

A series fan frame body structure made of different materials includes at least two fans, which are serially connected with each other. The fan frames of the two fans are made of different plastic materials. Accordingly, the excited frequency of the fan is prevented from being close to the natural frequency of the fan frames. Therefore, the vibration frequencies of the fan frames are different from each other so that the co-vibration is reduced to lower the noise. By means of the series fan frame body structure made of different materials, the problem of vibration of the fan is effectively improved.

6 Claims, 7 Drawing Sheets

(56) References Cited

U.S. PATENT DOCUMENTS

| | | | | |
|---|---|---|---|---|
| 7,542,272 | B2 * | 6/2009 | Pike | G06F 1/20 165/80.3 |
| 7,661,927 | B2 * | 2/2010 | Hsu | H05K 7/20172 415/121.2 |
| 7,871,243 | B2 * | 1/2011 | Chen | F01D 21/045 415/149.1 |
| 7,874,796 | B2 * | 1/2011 | Chang | F04D 19/007 415/119 |
| 8,651,807 | B2 * | 2/2014 | Inada | F04D 25/0613 415/208.2 |
| 2012/0244015 | A1 | 9/2012 | Benson et al. | |
| 2012/0301304 | A1 * | 11/2012 | Kenyon | A61M 16/0057 416/185 |
| 2015/0219120 | A1 * | 8/2015 | Chang | F04D 29/668 415/119 |

FOREIGN PATENT DOCUMENTS

| | | | |
|---|---|---|---|
| TW | 200827563 | A | 7/2008 |
| TW | 201131443 | A | 9/2011 |
| TW | M481295 | A | 7/2014 |

* cited by examiner

SERIES FAN FRAME BODY STRUCTURE MADE OF DIFFERENT MATERIALS

BACKGROUND OF THE INVENTION

1. Field of the Invention

The present invention relates generally to a fan frame body structure, and more particularly to a series fan frame body structure made of different materials. The vibration frequencies of the fan frames of the series fan are different from each other so that the co-vibration of the fan is reduced to lower the noise.

2. Description of the Related Art

The materials of the existent fan frames can be generally classified into two types, that is, metal frame body made by means of casting and plastic frame body made by means of injection molding. The cast metal frame body such as aluminum-made frame body has a higher price due to higher material cost. The plastic frame body made by means of injection molding, such as PBT, PA66 and PPE frame body has a much cheaper price than the metal frame body due to lower material cost so that the plastic frame body is popularly used in this field.

The forms of the current fans include one-fan form and series fan form. The fan in the one-fan form has a frame body simply made of plastic material such as PBT, PA66 or PPE. The series fan has two frame bodies serially connected with each other. The frame bodies are made of the same material of the same composition. For example, both frame bodies are made of PBT, PA66 or PPE.

No matter which form the fan has, the material and composition of the frame bodies are the same. Therefore, in the case that in operation of the fan, the excited frequency of the fan is close to the natural frequency of the fan frame, the fan will severely co-vibrate to make noise. This will ill affect the components of the fan to deteriorate the reading efficiency of hard disc of the system. Moreover, the lifetime of the system and the fan will be shortened.

It is therefore tried by the applicant to provide a series fan frame body structure made of different materials to solve the problem of co-vibration of the fan.

SUMMARY OF THE INVENTION

It is therefore a primary object of the present invention to provide a series fan frame body structure made of different materials. Due to the different materials, the vibration frequencies of the fan frames of the series fan are different from each other so that the co-vibration of the fan is reduced to lower the noise.

To achieve the above and other objects, the series fan frame body structure made of different materials of the present invention includes: a first fan including a first fan frame made of a first kind of plastic material; and a second fan including a second fan frame made of a second kind of plastic material. The second fan frame made of the second kind of plastic material is serially connected with the first fan frame made of the first kind of plastic material. The first kind of plastic material is different from the second kind of plastic material in composition. The first kind of plastic material is one of PBT, PA66, PPE, PA, PC, ABS and PPS, while the second kind of plastic material is another of PBT, PA66, PPE, PA, PC, ABS and PPS. The first fan frame vibrates at a first vibration frequency, while the second fan frame vibrates at a second vibration frequency. The first vibration frequency is different from the second vibration frequency.

In the above series fan frame body structure, the first fan frame has a first opening and a second opening. The first and second openings are respectively formed on two opposite sides of the first fan frame. A first flow passage communicates the first opening and the second opening with each other. A first base seat is positioned in the first flow passage. A first fan impeller is disposed on the first base seat.

In the above series fan frame body structure, the second fan frame has a third opening and a fourth opening. The third and fourth openings are respectively formed on two opposite sides of the second fan frame. A second flow passage communicates the third opening and the fourth opening with each other. A second base seat is positioned in the second flow passage. A second fan impeller is disposed on the second base seat.

According to the above arrangement, the co-vibration of the series fan can be effectively reduced to remove the vibration frequency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
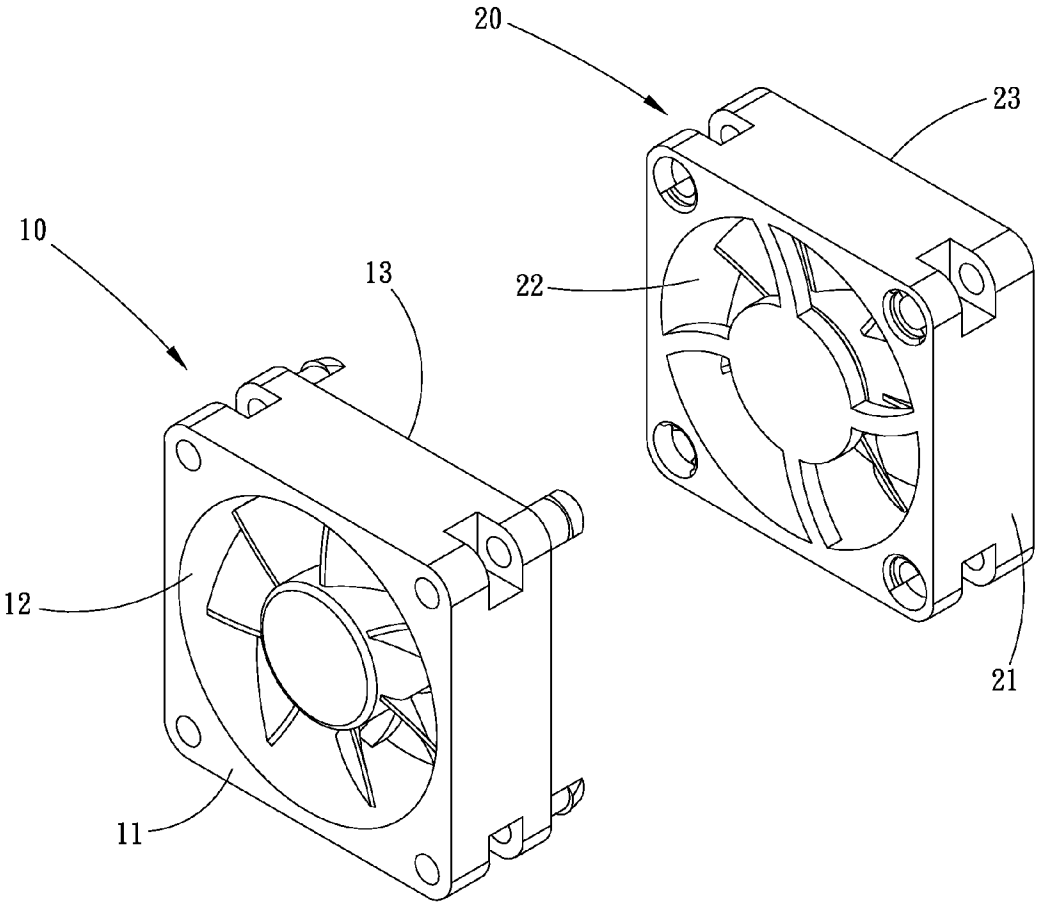
FIG. 1A is a perspective exploded view of the series fan structure of the present invention.

The embodiments of the present invention will be described hereinafter with reference to the drawings, wherein the same components are denoted with the same reference numerals.

Figure 1B:
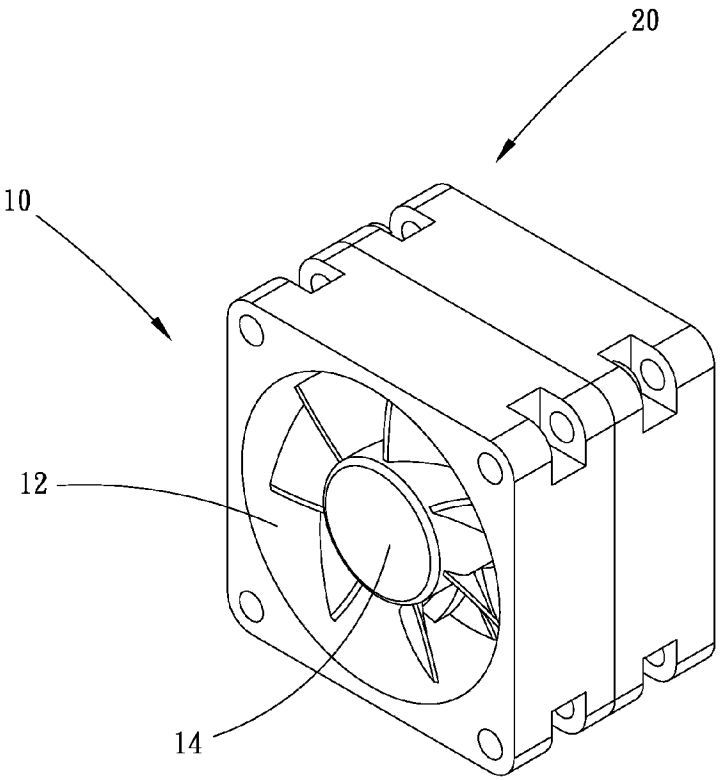
FIG. 1B is a perspective assembled view of the series fan structure of the present invention.
Figure 1C:
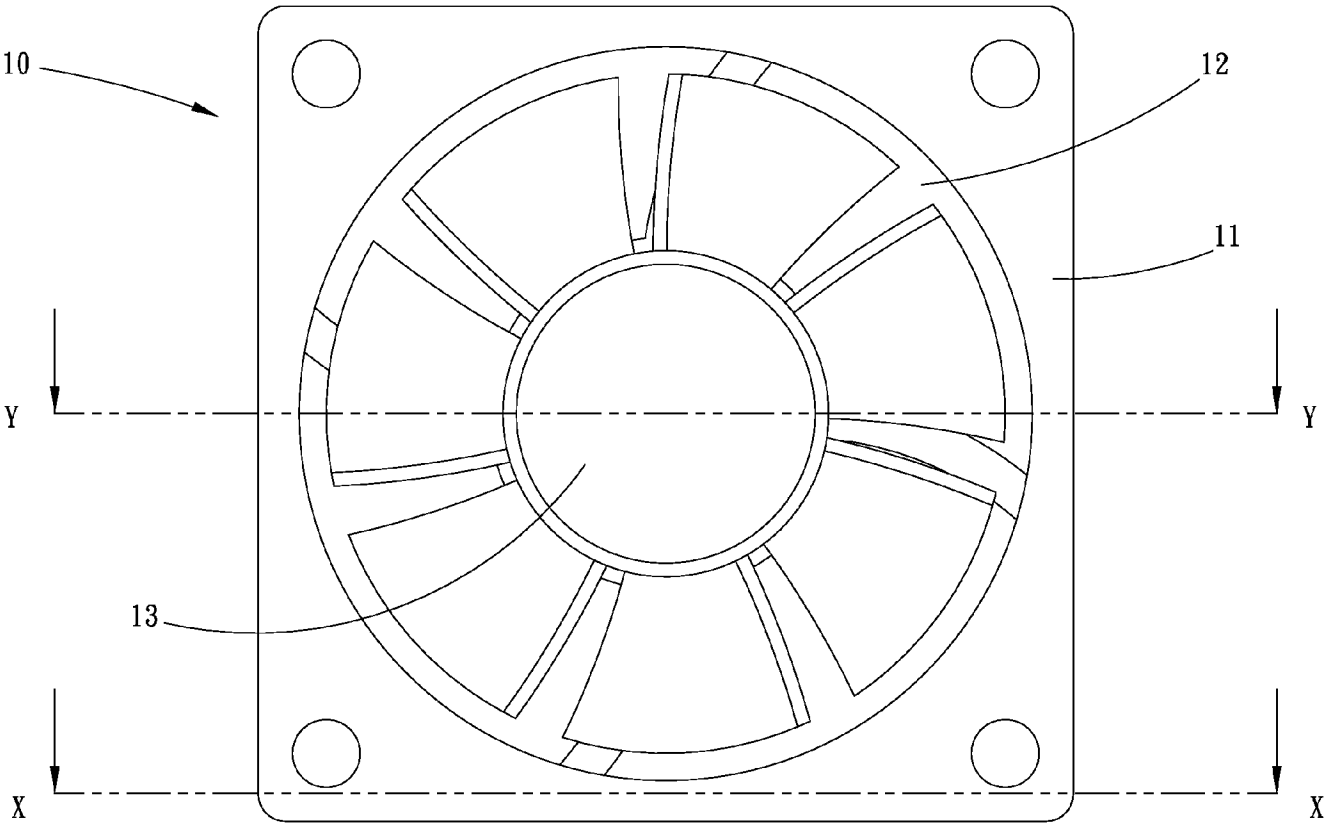
FIG. 1C is a top view of the series fan structure of the present invention.
Figure 2:
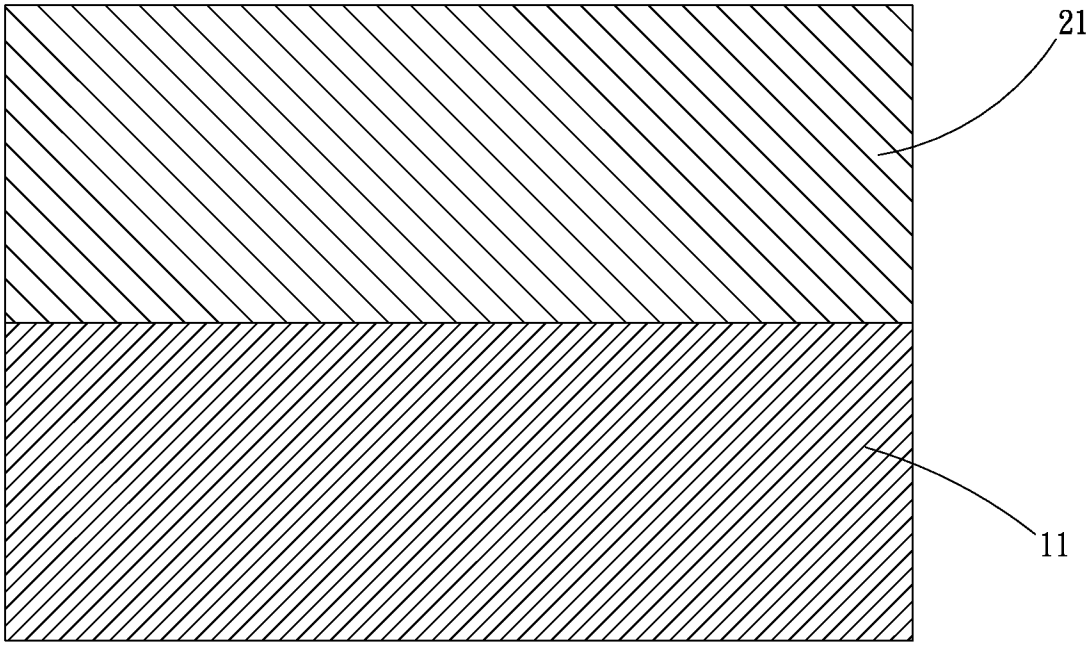
FIG. 2 is a sectional view taken along line X-X of FIG. 1C.
Figure 3:
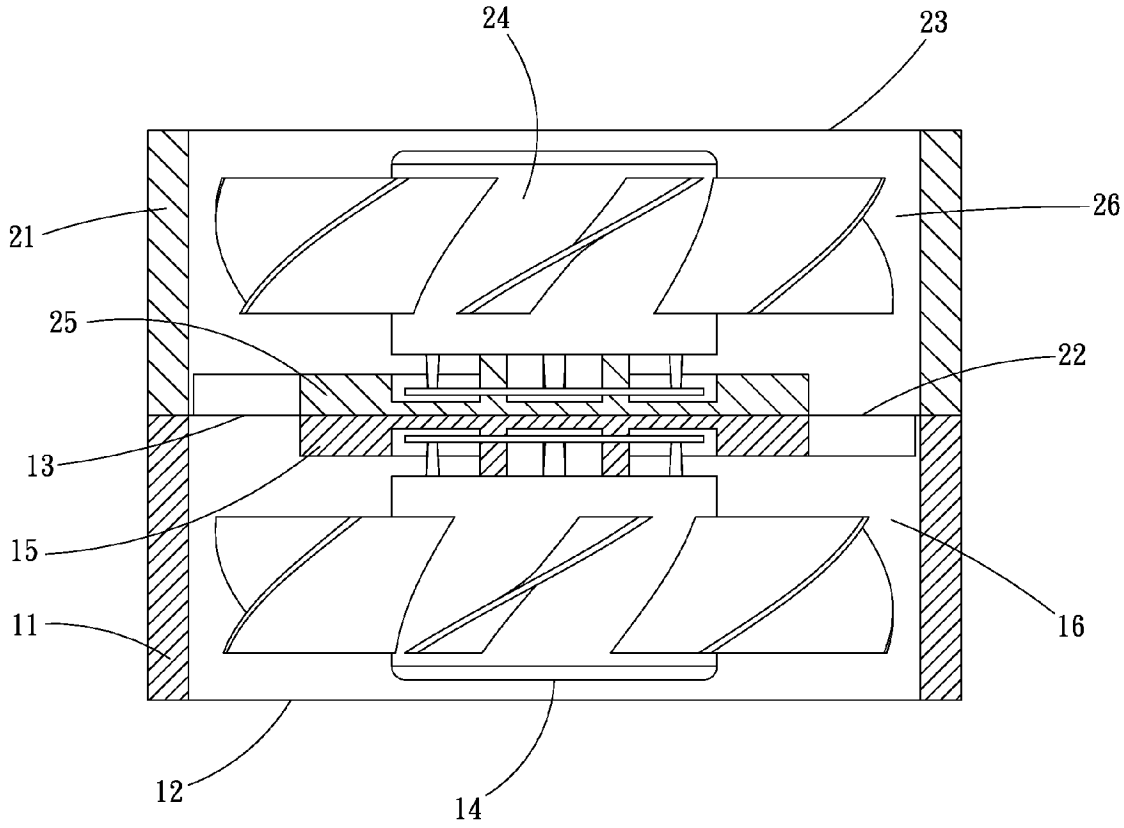
FIG. 3 is a sectional view taken along line Y-Y of FIG. 1C.

Please refer to FIGS. 1A, 1B, 1C, 2 and 3. FIG. 1A is a perspective exploded view of the series fan structure of the present invention. FIG. 1B is a perspective assembled view of the series fan structure of the present invention. FIG. 1C is a top view of the series fan structure of the present invention. FIG. 2 is a sectional view taken along line X-X of FIG. 1C. FIG. 3 is a sectional view taken along line Y-Y of FIG. 1C.

As shown in FIGS. 1A to 1C, 2 and 3, the series fan frame body structure made of different materials of the present invention includes a first fan 10 and a second fan 20, which are serially connected with each other. The first fan 10 includes a first fan frame 11 made of a first kind of plastic material. A first opening 12 and a second opening 13 are respectively formed on two opposite sides of the first fan frame 11. A first flow passage 16 communicates the first opening 12 and the second opening 13 with each other. A first base seat 15 is positioned in the first flow passage 16 in adjacency to the second opening 13. Multiple radial support ribs are disposed on an outer circumference of the first base seat 15 to connect with an inner wall of the first fan frame 11. A first fan impeller 14 is rotatably disposed on the first base seat 15.

The second fan 20 includes a second fan frame 21 made of a second kind of plastic material. A third opening 22 and a fourth opening 23 are respectively formed on two opposite sides of the second fan frame 21. A second flow passage 26 communicates the third opening 22 and the fourth opening 23 with each other. A second base seat 25 is positioned in the second flow passage 26 in adjacency to the third opening 22. Multiple radial support ribs are disposed on an outer circumference of the second base seat 25 to connect with an inner wall of the second fan frame 21. A second fan impeller 24 is rotatably disposed on the second base seat 25.

The second opening 13 of the first fan 10 is correspondingly adjacent to the third opening 22 of the second fan 20. The first flow passage 16 communicates with the second flow passage 26. When the first and second fan impellers 14, 24 rotate, the fluid flows through the first, second, third and fourth openings 12, 13, 22, 23. The first and second fans 10, 20 can be serially connected by any conventional measure. For example, the opposite sides of the first and second fans 10, 20 can be provided with mating members. Alternatively, the four corners of the two fans 10, 20 can be formed with perforations and four securing members can be correspondingly passed through the perforations to lock the two fans with each other. Still alternatively, the two fans can be connected with each other by means of adhesion.

It should be noted that the first plastic material and the second plastic material are different from each other in composition. The first plastic material is one of PBT (Polybutylene Terephthalate), PA66 (Polyamide 66 Resin), PPE, PA, PC, ABS and PPS. The second plastic material is another of PBT, PA66, PPE, PA, PC, ABS and PPS. In order to specifically distinguish the different materials from each other, the different materials are shown by different sectional lines in the drawings. As shown in the drawings, the first fan frame is made of PA66, while the second fan frame is made of PBT in adaptation to the first fan frame. In another embodiment, the first fan frame is made of PBT, while the second fan frame is made of PA66 in adaptation to the first fan frame.

The plastic material of the first fan frame 11 is different from the plastic material of the second fan frame 21 in composition. Therefore, when the first and second fan impellers 14, 24 operate, the first fan frame 14 vibrates at a first vibration frequency, while the second fan frame 24 vibrates at a second vibration frequency. The first vibration frequency is different from the second vibration frequency.

Moreover, the first and second base seats 15, 25 not only serve to support the first and second fan impellers 14, 24, but also serve to dissipate the heat. Accordingly, the first base seat 15 can be made of the same plastic material as the first plastic material of the first fan frame 11 or made of a metal material such as aluminum or copper. Similarly, the second base seat 25 can be made of the same plastic material as the second plastic material of the second fan frame 21 or made of a metal material such as aluminum or copper.

Figure 4A:
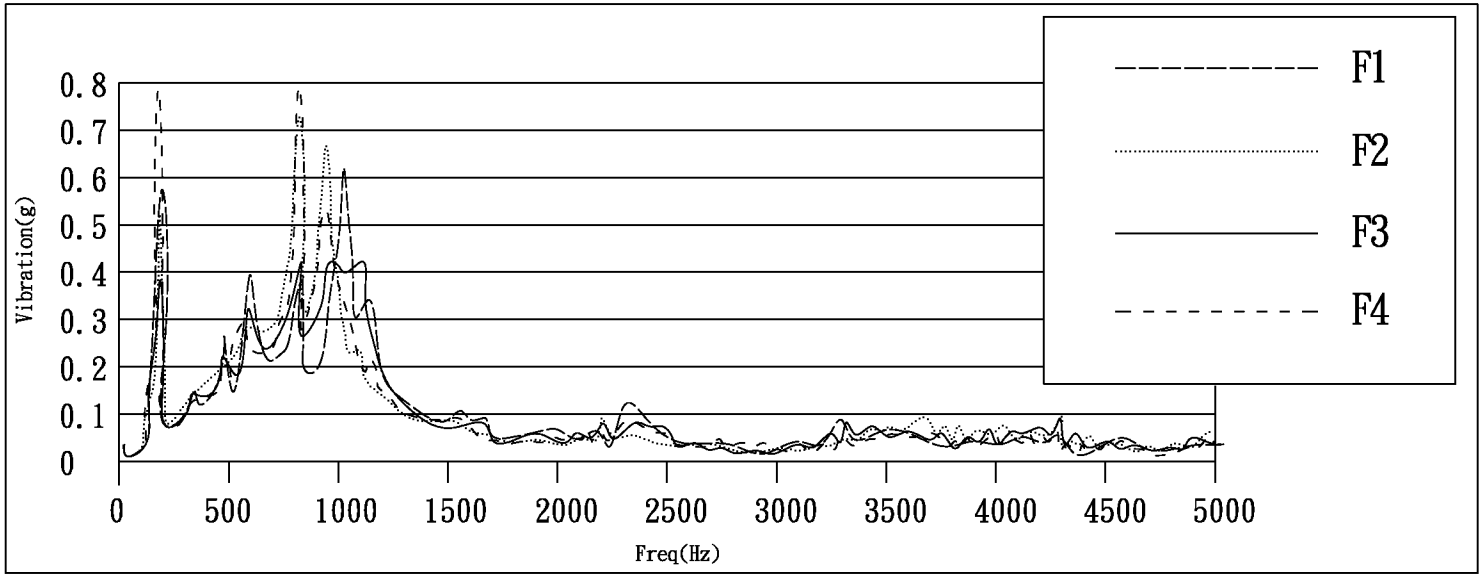
FIG. 4A is a diagram showing the comparison between the operational vibration of the fan frame of the series fan of the present invention and the fan frame of the conventional fan.
Figure 4B:
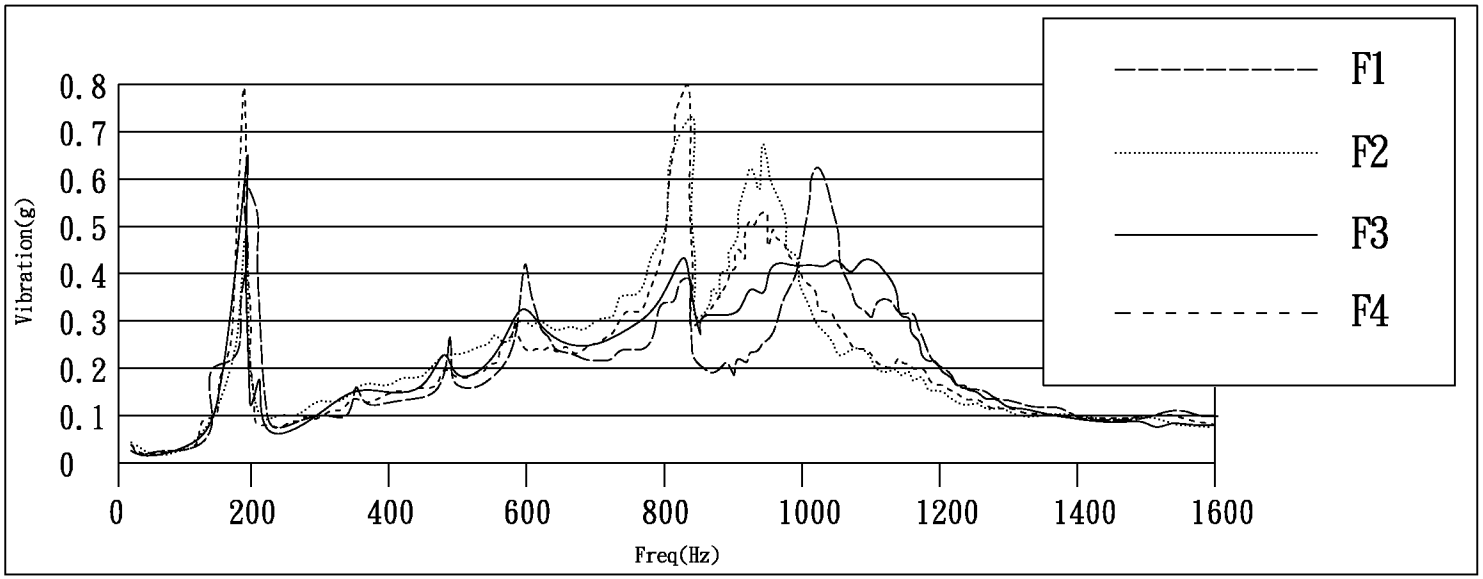
FIG. 4B is an enlarged diagram of a range of FIG. 4A.

Please now refer to FIGS. 4A and 4B. FIG. 4A is a diagram showing the comparison between the operational vibration of the fan frame of the series fan of the present invention and the fan frame of the conventional fan. FIG. 4B is an enlarged diagram of a range of FIG. 4A. In the diagrams, the curve F1 indicates the fan frame of the conventional series fan is made of single material of PBT. The curve F2 indicates the fan frame of the conventional series fan is made of single material of PA66. The curve F3 indicates the first fan frame 11 of the first fan 10 of the present invention is made of PA66, while the second fan frame 21 of the second fan 20 is made of PBT. The curve F4 indicates the first fan frame 11 of the first fan 10 of the present invention is made of PBT, while the second fan frame 21 of the second fan 20 is made of PA66. In FIG. 4A, the horizontal data mean the frequency up to 5000 Hz, while the vertical data mean the vibration g value. FIG. 4B is an enlarged diagram of a range of FIG. 4A from 0 to 1600 Hz. It can be seen from FIGS. 4A and 4B that as a whole, the vibration g value presentation of curve F3 of the present invention versus the respective frequencies is lower than the curves F1 and F2 of the conventional fans. However, as shown by the curve F4, it is also possible that the vibration of the conventional fan is not greatly improved as expected.

In conclusion, the first and second fan frames of the series fan of the present invention are made of different materials. The different materials have different vibration frequencies so that the co-vibration is reduced to remove the vibration frequency.

The present invention has been described with the above embodiments thereof and it is understood that many changes and modifications in the above embodiments can be carried out without departing from the scope and the spirit of the invention that is intended to be limited only by the appended claims.

What is claimed is:

1. A series fan frame body structure made of different materials, comprising:

a first fan including a first fan frame made of a first kind of plastic material; and a second fan including a second fan frame made of a second kind of plastic material, the second fan frame made of the second kind of plastic material being serially connected with the first fan frame made of the first kind of plastic material, the first kind of plastic material being different from the second kind of plastic material in composition.

2. The series fan frame body structure made of different materials as claimed in claim 1, wherein the first kind of plastic material is one of PBT, PA66, PPE, PA, PC, ABS and PPS, while the second kind of plastic material is another of PBT, PA66, PPE, PA, PC, ABS and PPS.

3. The series fan frame body structure made of different materials as claimed in claim 2, wherein, when the fans are operated, the first fan frame vibrates at a first vibration frequency, while the second fan frame vibrates at a second vibration frequency, the first vibration frequency being different from the second vibration frequency.

4. The series fan frame body structure made of different materials as claimed in claim 3, wherein the first fan frame has a first opening and a second opening, the first and second openings being respectively formed on two opposite sides of the first fan frame, a first flow passage communicating the first opening and the second opening with each other, a first base seat being positioned in the first flow passage, a first fan impeller being disposed on the first base seat.

5. The series fan frame body structure made of different materials as claimed in claim 4, wherein the second fan frame has a third opening and a fourth opening, the third and fourth openings being respectively formed on two opposite sides of the second fan frame, a second flow passage communicating the third opening and the fourth opening with each other, a second base seat being positioned in the second flow passage, a second fan impeller being disposed on the second base seat.

6. The series fan frame body structure made of different materials as claimed in claim 5, wherein the first base seat is made of the first kind of plastic material or a metal material and the second base seat is made of the second kind of plastic material or a metal material.

* * * * *